US005435249A

United States Patent [19]

Brent et al.

[11] Patent Number: 5,435,249

[45] Date of Patent: Jul. 25, 1995

[54] SHOCK TUBE INITIATOR WITH PHTHALOCYANINE COLOR INDICATOR

[75] Inventors: Geoffrey F. Brent, Mark's Point, Australia; Malcolm D. Harding, Irvine, Scotland

[73] Assignee: Imperial Chemical Industries PLC, United Kingdom

[21] Appl. No.: 139,942

[22] Filed: Oct. 20, 1993

[30] Foreign Application Priority Data

Oct. 20, 1992 [GB] United Kingdom ..... 9222001

[51] Int. Cl.[6] ..... C06B 45/00

[52] U.S. Cl. ..... 102/289; 149/123

[58] Field of Search ..... 149/123; 102/289

[56] References Cited

U.S. PATENT DOCUMENTS

| | | | |
|---|---|---|---|
| 3,993,838 | 11/1976 | Hejtmeijer et al. | 428/403 |
| 4,053,433 | 10/1977 | Lee | 252/408 |
| 5,208,419 | 5/1993 | Greenhorn et al. | 102/275.4 |
| 5,243,913 | 9/1993 | Brent et al. | 102/275.8 |

*Primary Examiner*—Peter A. Nelson

*Attorney, Agent, or Firm*—Charles Q. Buckwalter

[57] ABSTRACT

A shock tube initiator comprises a core charge having an oxidizer-rich fuel-oxidizer mixed particle system the mixed particle system containing co-mingled particles of finely comminuted organic dyestuff of the phthalocyanine family or a similarly thermally-stable organic dyestuff in sufficient quantity to impart a distinct color to the charge, the dyestuff being a material which does not decompose below 250° C.

10 Claims, No Drawings

SHOCK TUBE INITIATOR WITH PHTHALOCYANINE COLOR INDICATOR

This invention concerns blasting operations in which shock-robe or signal-tube transmission systems are used.

Shock tubes and signal tubes are classes of low-energy fuse used in blasting systems for transmitting an initiation signal from one point to another (usually from one detonator or pyrotechnic delay to another), such robes being constructed of plastic, usually extruded and unreinforced, and containing a particulate detonating or rapid reacting pyrotechnic composition distributed substantially uniformly along its central core at relatively low loadings compared to common detonating cords. The particulate composition is loosely adherent to the inner wall of the robe so that it is shock-dislodgeable. The internal bore of the robing is usually narrow, and is normally circular (though it need not be). Shock robe, for example, will typically consist of extruded plastic robe of internal diameter around 1–1.3 mm with a core loading of, say, HMX/Al (92:8 parts by weight) below 20 mg/m. Signal robe deigned for lower sisal transmission speeds (i.e. significantly below 2 km/s) will have similar dimensions, and will contain a rapid reacting pyrotechnic composition comprising a metal fuel e.g. Al or quasimetal fuel such as Si and a selected inorganic oxidant capable of sustaining reliable lower signal speed progression (as is $BaO_2$) typically at a core loading of around 20 mg/m to 100 mg/m. Reference may be made to European Patent No. 327 219 (ICI) for further information on shock robe products.

In field or mine situations it is not always immediately apparent to a blast engineer that a particular robe has fired merely from visual inspection of the still intact robe. This is in part because the visible colour change of the core material upon detonation or reaction may not be significant, especially at low core loadings. A further reason is that initiation systems prefer to supply coloured products and so the plastic of the shock/signal robe usually will be self-coloured, thus masking to a significant degree any core colour change that might otherwise have been perceptible. Additionally, natural or artificial light levels, especially underground, are not always at an intensity or spectral breadth conducive to perceiving a colour change in core material.

Addition of a colour enhancer to the core charge which becomes consumed in the course of the firing of the tube would, in principle, provide a basis for better visual differentiation of un-fired and fired tubes. In the specification of our British Patent Application No. 9119220.3, which has served as a priority application for multi-national patent applications, we have described one way of achieving effective substantial colour-change upon firing without needing to use a relative amount of colour enhancer that would interfere with, or substantially change, the performance of the tube as a shock tube or signal tube. The fundamental practical challenge facing the producer of shock tube initiation systems is that an incorporated colour enhancer will consume either energy, fuel or oxidizer on firing, will need to impart a significant colour enhancement (implying a significant presence), and will need to be "inert" under the conditions of the tube formation process, in terms both of its intrinsic thermal stability and of the reactivity of the core charge mixture containing it at the conditions under which the charge is loaded into the forming tube.

Our prior-described solution to this challenge was to use the metallic fuel as flake and to coat the surfaces of the flakes with coloured inorganic oxide so as both to mask the natural colour contribution of the fuel and to give a very high surface to mass ratio for the pigment.

We have now discovered an alternative solution. According to the present invention, the core charge of a shock tube/signal tube is an oxidizer-rich fuel-oxidizer mixed particle system containing co-mingled particles of finely comminuted organic dyestuff of the phthalocyanine family or a similarly thermally-stable "inert" organic dyestuff in sufficient quantity to impart a distinct colour to the charge. The dyestuff should not decompose below 250° C., preferably not below 300° C.

The excess oxidizer (i.e. more than sufficient to satisfy the demands of the metal/quasimetal fuel) is available to serve as oxidizer in the consumption of the organic dyestuff and, surprisingly, despite proportions of organic dyestuff up to about 3% by weight of the mixture being preferred in order to achieve desired colour enhancement, the performance of this core charge remains robust, reliable, and characteristic of the basic fuel-oxidizer system viz metal/quasimetal plus perchlorate. Simple tests will establish tolerance to higher contents of dyestuff.

The metal/quasimetal fuel is preferably Aluminium or Silicon or a mixture of the two. However, other metal/quasimetal fuels are taught in the art of shock tubes and signal tubes. It may be found advantageous to finely comminute the basic fuel and the dyestuff together before mixing them with the oxidiser. In this way the "covering" per unit mass of dyestuff may be enhanced allowing less usage for the same visual effect. Essentially, the finer the particle size of the dyestuff the better, within the safe practical range.

Amongst possible oxidizers are perchlorates and oxides containing peroxide links such as those taught in the prior literature of signal tubes but especially alkali metal perchlorates e.g. $KCLO_4$ and $BaO_2$. However, we prefer to use ammonium perchlorate as the oxidizer. The thermal stability of the core charge and the quality of initiating signal pick-up, travel, and transfer achieved by say Al/AP (8:92 by weight) or Al:Si:AP (8:20:72) at low core loadings of finely particulate surface-adherent (but shock dislodgeable) core charge are excellent. Thus, a mixture of Al/AP/IBBCS (blue phthalocyanine pigment) in a weight ratio of 6:91:3 and used at a core loading of around 16–20 mg/meter in a tube of around 1.0–1.3mm ID provided excellent signal pick-up and transfer (1700 $msec^4$, 6 MPa peak pressure) as well as a most marked colour change on firing despite 3% by weight of particulate dyestuff being present. In this case, the ingredients of the core charge were individually comminuted and were then blended together. Indications are that by co-comminuting the Al and the IBBCS the same visual effect would have been achieved using less IBBCS, but the above-described example is a sterner test of the robustness of systems in accordance with this invention. Tests of thermal stability of compounds and mixtures are suitably carried out according to the Henkin test or using a differential scanning calorimeter. Indicative mean particle sizes for the core charge ingredients are:

Al—paint fine grade (0.1×5.0 microns)

Si—10–15 microns

AP—passes through a 38 micron sieve

IBBCS—as supplied by Ciby-Geigy (mostly less than 5 microns)

NOTE: IBBCS is IRGALITE BLUE BCS (an Alpha-Copper—phthalocyanine). IRGALITE is a trade name of Ciba-Geigy.

We claim:

1. A shock tube initiator comprising a core charge having an oxidizer-rich fuel-oxidizer mixed particle system, the mixed particle system containing co-mingled particles of finely comminuted organic dyestuff of the phthalocyanine family.

2. The shock tube initiator claimed in claim 1 wherein the fuel is a metal/quasimetal fuel.

3. The shock tube initiator claimed in claim 2 wherein the fuel is selected from the group consisting of aluminium, silicon and a mixture of both.

4. The shock tube initiator claimed in claim 1 wherein the oxidizers are selected from the group consisting of inorganic perchlorates and oxides having peroxide links.

5. The shock tube initiator claimed in claim 4 wherein the oxidizers are metal perchlorates.

6. The shock tube initiator claimed in claim 4 wherein the oxidizer is ammonium perchlorate.

7. The shock tube initiator claimed in claim 1 wherein the dyestuff does not decompose below about 300° C.

8. The shock tube initiator claimed in claim 1 wherein the proportion of dyestuff is about 3% of the mixed particle system.

9. The shock tube initiator claimed in claim 1 wherein the mean size of the dyestuff is less than about 5 microns.

10. The shock tube initiator claimed in claim 1 wherein the tube has an internal diameter of from about 1.0 to about 1.3 mm and the mixed particle system is present as a core loading of from about 16 to about 20 mg/meter.

* * * * *